US008113260B2

(12) United States Patent
Llagostera Forns

(10) Patent No.: US 8,113,260 B2
(45) Date of Patent: Feb. 14, 2012

(54) ARTICULATION DEVICE FOR AWNING ARM ELBOW

(75) Inventor: Joan Llagostera Forns, Reus (ES)

(73) Assignee: Llaza, SA, Reus (Tarragona) (ES)

( * ) Notice: Subject to any disclaimer, the term of this patent is extended or adjusted under 35 U.S.C. 154(b) by 407 days.

(21) Appl. No.: 12/443,250

(22) PCT Filed: Sep. 27, 2006

(86) PCT No.: PCT/ES2006/000532
§ 371 (c)(1),
(2), (4) Date: Jul. 20, 2009

(87) PCT Pub. No.: WO2008/037815
PCT Pub. Date: Apr. 3, 2008

(65) Prior Publication Data

US 2009/0301664 A1 Dec. 10, 2009

(51) Int. Cl.
*E04F 10/06* (2006.01)

(52) U.S. Cl. ..... 160/79; 160/70

(58) Field of Classification Search ..... 160/79, 160/70, 22, 66, 67; 135/88.11, 88.12
See application file for complete search history.

(56) References Cited

U.S. PATENT DOCUMENTS

| | | | | |
|---|---|---|---|---|
| 6,904,826 | B2 * | 6/2005 | Hesener | 74/483 R |
| 7,645,088 | B2 * | 1/2010 | Voss | 403/345 |
| 2006/0151125 | A1 * | 7/2006 | Llagostera Forns | 160/79 |
| 2007/0051476 | A1 * | 3/2007 | Forns | 160/79 |

FOREIGN PATENT DOCUMENTS

| | | | |
|---|---|---|---|
| EP | 0 125 727 | A1 | 11/1984 |
| ES | 2 159 211 | | 9/2001 |
| ES | 1 051 839 | | 10/2002 |
| ES | 2 191 843 | | 9/2003 |
| WO | WO2005/017278 | A1 | 2/2005 |
| WO | WO2005/017279 | A1 | 2/2005 |

OTHER PUBLICATIONS

International Search Report for PCT International Application No. PCT/ES2006/000532, mailed Feb. 16, 2007.

* cited by examiner

*Primary Examiner* — David Purol
(74) *Attorney, Agent, or Firm* — RatnerPrestia

(57) ABSTRACT

An articulation device for an awning arm elbow includes a forearm elbow part defining a fork between the branches of which a core configured around an axis is supported. A flexible tie rod is coupled to the core and is connected to an elastic member. An arm elbow part defines a surrounding wall around the core. Bearings act to guide relative rotation between the forearm and arm elbow parts and to support the forearm on the arm. The bearings include at least one bearing unit which includes a first annular element fixed to the forearm elbow part and a second annular element fixed to the arm elbow part. These first and second annular elements include respective facing surfaces which cooperate in the functions of the bearings.

17 Claims, 6 Drawing Sheets

ARTICULATION DEVICE FOR AWNING ARM ELBOW

This application is a U.S. National Phase Application of PCT International Application No. PCT/ES2006/000532, filed Sep. 27, 2006.

TECHNICAL FIELD

The present invention relates to an articulation device for an awning arm elbow, said awning arm being of the type formed by a forearm and an arm articulated in said elbow, where the free end of the forearm is provided with a configuration for articulated attachment to a load bar fixed to a front edge of the awning canvas and the free end of the arm is provided with a configuration for articulated attachment to a fixed support adjacent to a winding tube for the canvas, and where inside the arm there is arranged at least one elastic traction member connected to a flexible tie rod element having an end anchored in the articulation device for the elbow.

BACKGROUND OF THE INVENTION

International patent application WO 2005/017278 discloses an articulated arm for awnings of the type described above, formed by a forearm and an arm articulated in an elbow by means of an articulation device. This articulation device comprises a forearm elbow part and an arm elbow part. The forearm elbow part defines a fork between the branches of which a core configured around an axis is fixedly supported. In the mentioned core there is formed an anchoring configuration adapted to couple an enlarged end of the mentioned flexible tie rod element connected to said elastic traction member. The mentioned flexible tie rod element is described in patent ES-A-2159211. The arm elbow part defines a surrounding wall arranged around the core, a clearance being provided between both to accommodate said flexible tie rod element.

To guide a relative rotation between the forearm and arm elbow parts around said axis, and to support the forearm on the arm in a cantilevered manner, the articulation device includes bearing means formed by a pair of annular parts, made of a plastic material, assembled on the surrounding wall of the arm elbow part. These annular parts define a pair of first conical surfaces which in an operative situation face one another and are in contact with a corresponding pair of second conical surfaces formed in the core and in a centering part, respectively, which are integral with the forearm elbow part. The first and second conical surfaces are conjugated and provided for a relative sliding.

A tubular shank coaxial with the axis is inserted in a hollow interior of the core. One of the branches of the fork of the forearm elbow part defines a hole for an end of said shank and the other branch of the fork defines an opening into which the mentioned centering part is fitted, which centering part in turn has a hole for the other end of the shank. The centering part is configured to block the rotation of the core. Once the assembly is completed, the ends of the shank are flared against the holes in the branch of the fork and the centering part, whereby the shank is retained and the assembly is firmly packed.

This construction has several drawbacks. For example, the forearm and arm elbow parts, as well as the core and the centering part, are generally obtained by the injection molding of a lightweight metal alloy, such as aluminium, and the correct adjustment of the conical surfaces demands strict manufacture and assembly tolerances that are difficult to achieve by means of such molded aluminium parts without a subsequent machining. The lack of a correct adjustment can give rise to squeaks while bending and straightening the elbow. Furthermore, a play, however small it is, in the articulation of the elbow can cause a misalignment of the correct position of the forearm with respect to the arm, and this can create interferences, for example, when the articulated arm must be automatically introduced in a bent position into a box during an operation for drawing in the awning. This misalignment will be greater the longer the forearm is. Therefore, a lack of adjustment in the articulation of the elbow limits the maximum length that the forearm can have to be supported in a cantilevered manner by the bearing means in a suitable position. In addition, the friction forces existing in the articulation device for the elbow are to the detriment of the force exerted by the elastic traction member, and as a result there is a decrease in the tension of the canvas.

It is therefore desirable to increase the adjustment and precision to a maximum and to decrease the friction forces to a minimum in the bearing means of the articulation device for the elbow of an articulated arm for an awning.

DISCLOSURE OF THE INVENTION

The present invention contributes to overcoming the previous and other drawbacks by providing an articulation device for an awning arm elbow, said awning arm being formed by a forearm and an arm articulated in said elbow. The articulation device is of the type comprising a forearm elbow part, an arm elbow part and bearing means arranged to guide a relative rotation between said forearm elbow part and said arm elbow part around an axis, and to support the forearm on the arm. The mentioned forearm elbow part defines a fork between the branches of which a core configured around said axis is fixedly supported. In the mentioned core there is formed an anchoring configuration adapted to couple an enlarged end of a flexible tie rod element connected to one or more elastic traction members secured at a fixed point inside said arm. The mentioned arm elbow part defines a surrounding wall arranged around said core, with a clearance arranged between both to accommodate said flexible tie rod element. The articulation device of the present invention is characterized in that said bearing means include at least one bearing unit which comprises a first annular element which is fixed to the forearm elbow part and a second annular element which is fixed to the arm elbow part. These first and second annular elements include respective facing surfaces adapted to mutually cooperate in the functions of the bearing means.

In one embodiment, the articulation device includes two bearing units, at least one of which is a roll bearing in which said first annular element fixed to the forearm elbow part defines an inner roll track and said second annular element fixed to the arm elbow part defines an outer roll track. These inner and outer roll tracks form part of the mentioned facing surfaces, and a plurality of rolling elements are arranged therebetween to roll on both. The roll bearing can be of different types, including ball bearings, needle bearings, cylindrical or tapered roller bearings, etc. A suitable type of roll bearing is, for example, a single-row rigid ball bearing, preferably of stainless steel and sealed or provided with side protections. The single-row rigid ball bearing withstands both radial and axial forces and is commercially available.

The parts forming the structure of the articulation device for the elbow, i.e., the forearm and arm elbow parts, as well as the core and centering parts, are generally obtained by the injection molding of a lightweight metal alloy, such as, for example, an aluminium alloy, and are usually completely coated with a layer of paint or lacquer. In the core and in the surrounding wall defined by the arm elbow part there are seats for the first annular element and the second annular element, respectively, of the roll bearing. These seats are formed during the molding operation and coated with the layer of paint or lacquer. Due to the demands of the molding technique, specifically to facilitate the demolding, the surfaces oriented in the demolding direction must be slightly conical. For this reason, in other applications, the seats for roll bearings and other components generally require being machined after the molding to eliminate or rectify the mentioned conicity, which makes the manufacturing process considerably more expensive.

According to one embodiment of the present invention, the seats for the roll bearings are configured such that the roll bearings can be directly housed in the housings as they are obtained in the parts shaped by injection molding, even having been subsequently lacquered or painted, without needing a prior machining.

To that end, each of the seats in the device of the present invention comprises a conical surface, coaxial with the axis of the articulation and provided with a degree of conicity, from which there project ribs defining radial support surfaces, each of which has at least one edge coinciding with a cone coaxial with the axis of the articulation and also provided with a degree of conicity. The degrees of conicity of the conical surface and of the radial support surfaces of the ribs are small and no more than those necessary to allow a correct demolding of the core and/or of the arm elbow part after the operation for obtaining them by injection molding. The radial support surfaces of the ribs are adapted to receive by pressurized insertion a cylindrical radial support surface of the roll bearing. The mentioned ribs are sized for the purpose of at least one part of their radial support surfaces being adjusted with interference with the radial rest surface of the roll bearing, taking into account the thickness of the layer of paint or lacquer when there is one. Given that the material of the annular elements of the roll bearing, typically steel, is harder than the material of the parts defining the seats, for example, an aluminium alloy, the roll bearing sweeps an amount of material of the ribs during an operation for installing the roll bearing by pressurized insertion in the axial direction in the seat until an axial rest surface of the roll bearing makes contact with an axial support surface of the seat perpendicular to the axis of the articulation. In said axial support surface and in a position adjacent to the ribs there is formed a circumferential channel adapted to receive and house the possible material of the ribs of the seat pulled off by the roll bearing, whether it is aluminium alloy or paint or lacquer, or a combination of both, during the operation for installing the roll bearing by pressurized insertion.

In another embodiment, the articulation device includes two bearing units, at least one of which is a friction bearing in which the mentioned facing surfaces comprise respective first and second cylindrical surface portions in contact, to withstand forces in the radial direction, and respective first and second annulus surface portions in contact, to withstand forces in the axial direction. The first and second annular elements are preferably made of different materials with a low coefficient of friction between one another. Steel and bronze, steel and plastic, bronze and plastic, for example, among others, can be mentioned as suitable pairs of materials for the first and second annular elements of the friction bearing.

When one of the annular elements of the friction bearing is made of a hard material, for example steel, in relation to the softest material of the structural part, for example aluminium, the corresponding structural part of the articulation device, whether it is the arm elbow part or the core, defines a seat similar to that described above in relation to the bearing, for receiving the annular element of the friction bearing by pressurized insertion.

When one of the annular elements of the friction bearing is made of a material that is less hard and/or can be shaped by molding, for example bronze, a reverse construction can be made in which the ribs are formed in the annular element of the friction bearing instead of the conical surface of the seat. Thus, in one embodiment, the seat for the annular element of the friction bearing comprises a conical radial support surface, coaxial with the axis of the articulation, provided with a small degree of conicity suitable for facilitating the demolding of the part during its manufacture by injection molding. This conical radial support surface is adapted to receive by pressurized insertion radial rest surfaces formed in ribs projecting from a surface of the friction bearing. Each of these radial rest surfaces of the ribs has at least one edge preferably coinciding with a cylinder. The housing also includes an axial support surface perpendicular to the axis, adapted to receive an axial rest surface of the friction bearing. A circumferential channel adjacent to said conical surface is formed on this axial support surface to receive and house the possible material pulled off by the annular element of the friction bearing from the conical surface of the seat during the operation for installing the annular element by pressurized insertion in the axial direction.

When one of the annular elements of the friction bearing is made of a relatively soft and/or elastic material, for example a plastic polymer, the seat is preferably machined to provide a cylindrical radial rest surface ensuring a complete backing for a cylindrical radial rest surface of the annular element.

According to the present invention, a feature common to the embodiment with a roll bearing and to the embodiment with a friction bearing is that a structural part of the articulation device includes a seat for at least one of the two annular elements of the roll bearing or friction bearing, where the mentioned seat has one or more surfaces coinciding with a cone coaxial with the axis of the articulation provided with a degree of conicity suitable for facilitating demolding, and adapted to receive by pressurized insertion one or more surfaces coinciding with a cylinder coaxial with the axis of the articulation, formed in the corresponding annular element of the roll bearing or friction bearing.

The present invention contemplates the possibility of the articulation device including a single bearing unit, either in the form of a roll bearing or of a friction bearing, provided that the single roll bearing or friction bearing is of a suitable type and is properly sized.

BRIEF DESCRIPTION OF THE DRAWINGS

The previous and other features and advantages will be more fully understood from the following detailed description of several embodiments with reference to the attached drawings in which.

DETAILED DESCRIPTION OF EXEMPLARY EMBODIMENTS

Figure 1:
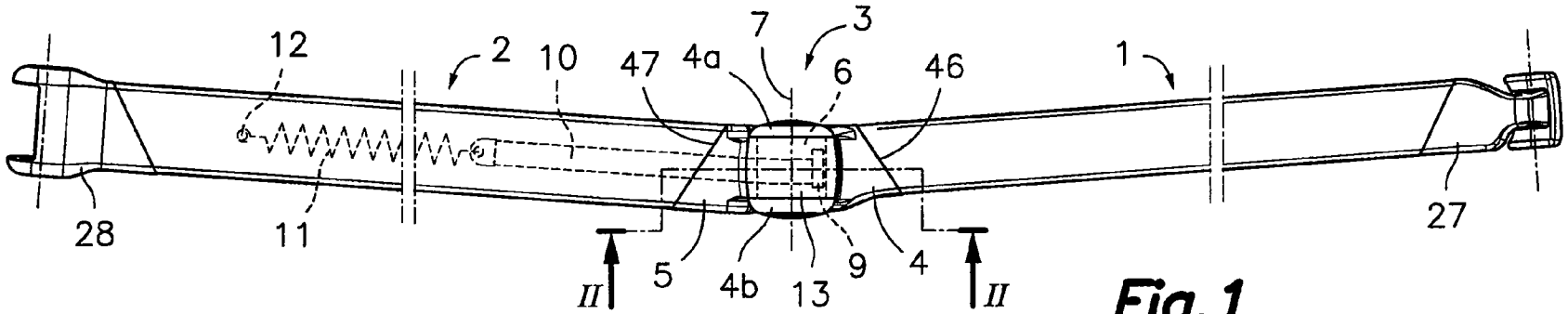
FIG. 1 is a side view of an articulated arm for an awning provided with an articulation device for an elbow according to the present invention.
Figure 2:
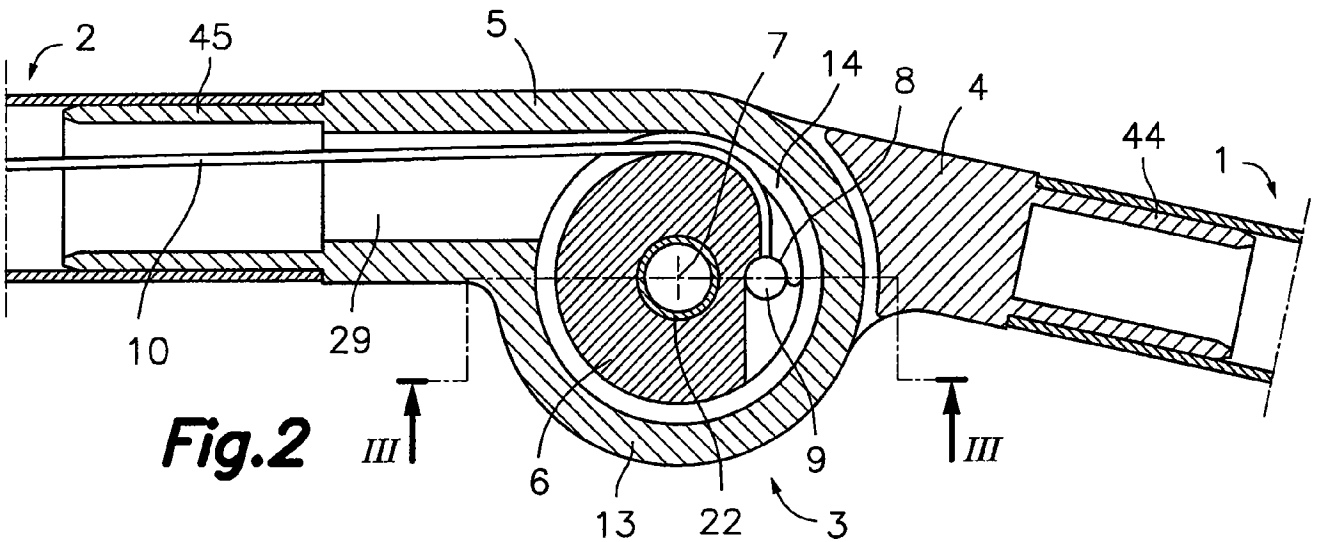
FIG. 2 is a partial cross-sectional view taken through a plane indicated by line II-II of FIG. 1.

Referring first to FIGS. 1 and 2, the articulation device for an awning arm elbow of the present invention is applicable to an articulated arm formed by a forearm 1 and an arm 2 articulated in an elbow 3 for one to rotate with respect to the other around an axis 7. The forearm 1 is formed by an elongated tubular section finished at a first end by a forearm elbow part 4 adapted for the articulated attachment of the forearm 1 to the arm 2 and at an opposite second end by a connecting part 27 adapted for the articulated attachment of the free end of the forearm 1 to a load bar (not shown) fixed to a front edge of a canvas of the awning. Similarly, the arm 2 is formed by an elongated tubular section finished at a first end by an arm elbow part 5 adapted for the articulated attachment of the arm 2 to the forearm 1 and at an opposite second end by a connecting part 28 adapted for the articulated attachment of the free end of the arm 2 to a support (not shown) adjacent to a winding tube for the canvas of the awning. Bearing means are arranged to guide a relative rotation between the forearm elbow part 4 and the arm elbow part 5 around the axis 7, and to support the forearm 1 on the arm 2 in a cantilevered manner.

The forearm and arm elbow parts 1, 2 include plug-in configurations 44, 45 adapted to be inserted in the open ends of the tubular sections of the forearm 1 and the arm 2, respectively. The mentioned plug-in configurations 44, 45 can be delimited by inclined flanges 46, 47 adapted to abut against inclined cut ends of the tubular sections of the forearm 1 and the arm 2, respectively, according to international patent application WO 2005/017279. The connecting parts 27 and 28 can be coupled to the respective tubular sections of the forearm 1 and the arm 2 by means of plug-in configurations provided with inclined flanges similar to those mentioned.

The forearm elbow part 4 defines a fork between the branches 4*a*, 4*b* of which a core 6 configured around the axis 7 is fixedly supported. In said core 6 there is formed an anchoring configuration 8 (FIG. 2) adapted to couple an enlarged end 9 of a flexible tie rod element 10 connected to an elastic member 11 in the form of a helical traction spring secured in an anchor 12 inside said arm 2. Alternatively, inside the arm 2 there can be two or more combined elastic members under traction and compression to pull on the flexible tie rod element 10. The arm elbow part 5 defines a surrounding wall 13 arranged around said core 6, there being a clearance 14 between the surrounding wall 13 and the core 6 to accommodate said flexible tie rod element 10. The surrounding wall 13 has an opening communicating the clearance 14 with a passage 29 formed through the arm elbow part 5 and the corresponding plug-in configuration to allow the passage of the flexible tie rod element 10 into the tubular section of the arm 2. Documents ES-A-2159211 and ES-A-2191843 disclose a flexible tie rod element such as the one described above, and international patent application WO 2005/001728 describes an alternative arrangement for the function of the elastic traction member of the flexible tie rod element compatible with the articulation device of the present invention.

The tubular sections of the forearm 1 and the arm 2 can be extruded profiles made of a lightweight metal alloy, for example, an aluminium alloy, and the structural parts of the articulation device, i.e., the forearm and arm elbow parts 4, 5, the core 6 and centering parts 23 are designed to be obtained by injection molding of a lightweight metal alloy, for example, an aluminium alloy.

Figure 3:
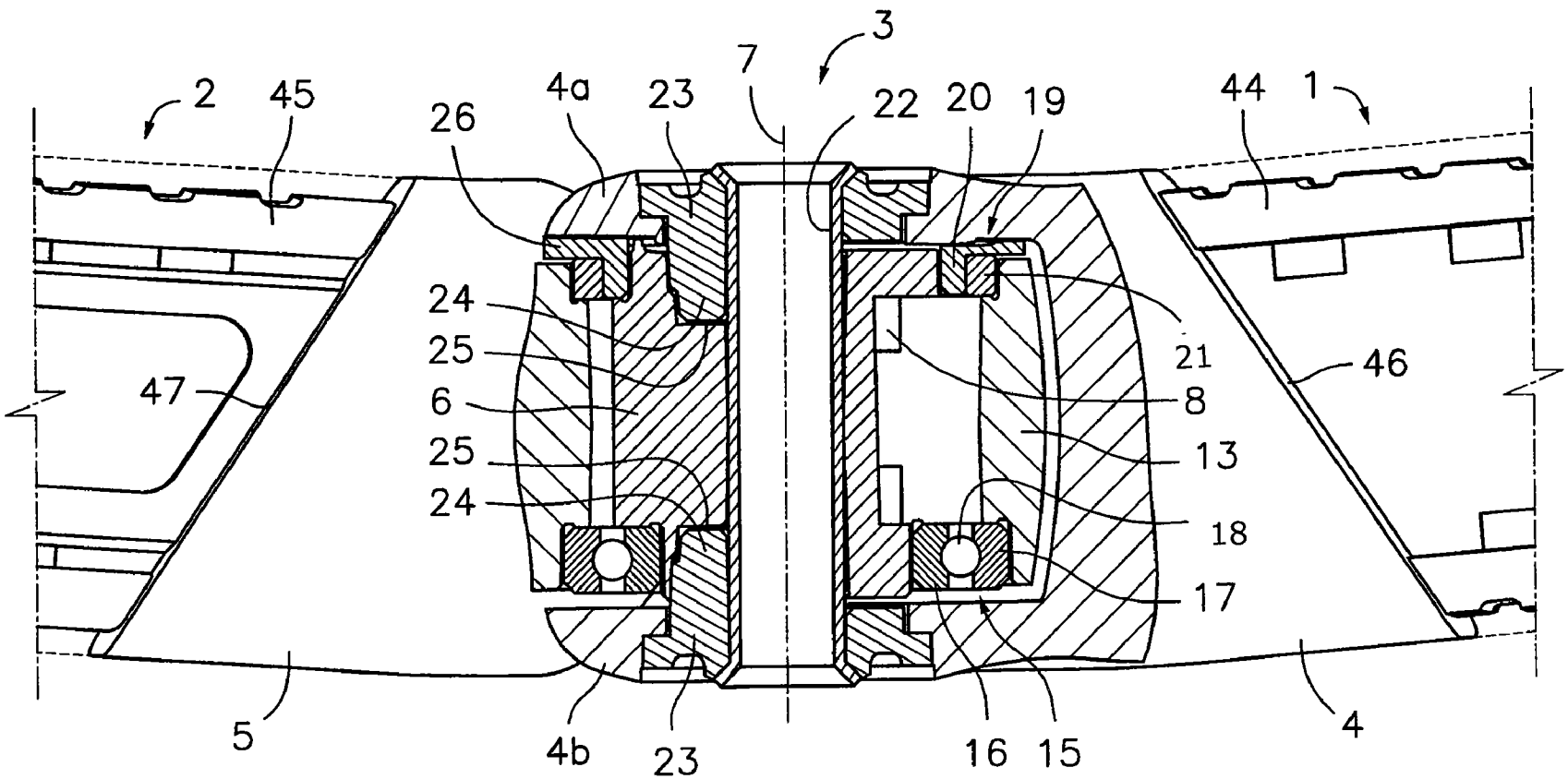
FIG. 3 is a partial cross-sectional view taken through a plane indicated by line III-III of FIG. 2, showing an embodiment of the present invention including a roll bearing and a friction bearing.

With specific reference now to the embodiment shown in FIG. 3, the mentioned bearing means of the articulation device include a pair of bearing units located adjacent to the branches 4*a*, 4*b* of the fork, or in other words, at opposite ends of the core 6. In the illustrated embodiment, the bearing unit located at the lower end of the core 6 is a roll bearing 15 and the bearing unit located at the upper end of the core 6 is a friction bearing 19. This is so because the lower end of the articulation has more mechanical stress than the upper end, although there is no limitation for the construction being the reverse one.

The mentioned roll bearing 15 is of a conventional type and comprises a first annular element 16 which is fixed to the forearm elbow part 4 and a second annular element 17 which is fixed to the arm elbow part 5. These first and second annular elements 16, 17 include respective facing surfaces defining inner and outer roll tracks, respectively, on which a plurality of rolling elements 18 arranged therebetween roll. The facing surfaces of the first and second annular elements 16, 17 are thus adapted to mutually cooperate in the functions of the bearing means. The rolling elements 18 can be balls, cylindrical rollers, tapered rollers, needles, etc. In the embodiment shown in FIG. 3, the roll bearing 15 is a conventional single-row rigid ball bearing, which is adapted to withstand radial forces and axial forces. The roll bearing 15 is preferably made of stainless steel and sealed to be weather-resistant. The first annular element 16 of the roll bearing 15 is assembled on the core 6, which is in turn fixed to the forearm elbow part 4 by means of centering parts 23 and a central shank 22, as will be explained in detail below, and the second annular element 17 is assembled on the surrounding wall 13 forming part of the arm elbow part 5. For the installation of the roll bearing 15, the core 6 defines a seat for the first annular element 16 of the roll bearing 15 and the surrounding wall 13 defines a seat for the second annular element 17 of the roll bearing 15.

Figure 7:
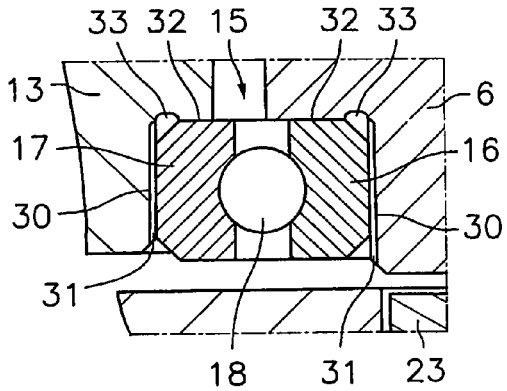
FIG. 7 is an enlarged detailed cross-sectional view taken through a plane parallel to the axis, showing a seat arrangement for a roll bearing.
Figure 8:
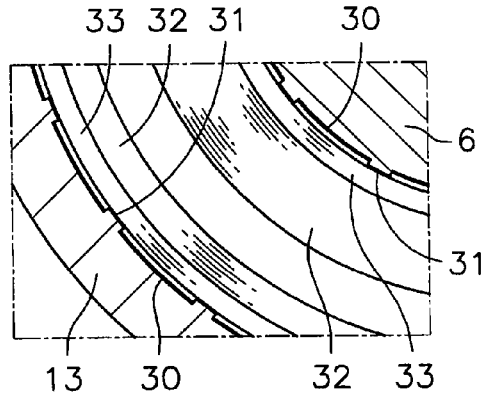
FIG. 8 is an enlarged detailed cross-sectional view taken through a plane perpendicular to the axis, showing the seats of the seat arrangement of FIG. 7.

As best shown in FIGS. 7 and 8, each of the mentioned seats comprises a conical surface 30, coaxial with the axis 7, provided with a small degree of conicity, and ribs 31 projecting from said conical surface 30. The mentioned ribs 31 are distributed around the axis 7 and each of them defines a radial support surface having at least one edge coinciding with an imaginary cone coaxial with the axis 7 and likewise provided with a small degree of conicity. Preferably, the entire radial support surface of each rib 31 coincides with said imaginary cone. The mentioned radial support surfaces of the ribs 31 are adapted to receive by pressurized insertion in the axial direction cylindrical inner and outer radial rest surfaces existing in the corresponding first and second annular elements 16, 17 of the roll bearing 15. The bottoms of the seats are formed by axial support surfaces 32, perpendicular to the axis 7, adapted to receive axial rest surfaces existing in the corresponding first and second annular elements 16, 17 of the roll bearing 15. In each of said axial support surfaces 32 there is formed a circumferential channel 33 located adjacent to the ribs 31. The degree of conicity of the conical surface 30 and the degree of conicity of the radial support surfaces of the ribs 31 is relatively small, for example, less than one degree, and is sufficient to allow the demolding when the core 6 and/or the arm elbow part 5 defining the surrounding wall 13 are obtained by the injection molding of a lightweight metal alloy, for example, an aluminium alloy. As is usual, the core 6 and/or the arm elbow part 5 defining the surrounding wall 13 can be completely coated with a layer of paint or lacquer applied after its shaping by injection molding.

When the roll bearing 15 is inserted by pressure in the axial direction to the inside of the seats formed in the core 6 and the arm elbow part 5, the first and second annular elements 16, 17 of the roll bearing 15 interfere with the support surfaces of the ribs 31 pulling off some of the material and/or coating thereof, until the axial rest surfaces of the roll bearing 15 make contact with the axial support surfaces 32 of the seats. The material or coating of the seats pulled off by the roll bearing 15 is received and retained in the corresponding channels 33 in order to not interfere in the contact between the corresponding axial rest surfaces of the roll bearing 15 and the axial support surfaces 32 of the seats. The roll bearing 15 is thus perfectly seated in the seats.

With reference still to FIG. 3, the friction bearing 19 comprises a first annular element 20 assembled on the core 6, which is in turn fixed to the forearm elbow part 4, and a second annular element 21 fixed to the surrounding wall 13, which forms part of the arm elbow part 5. The first and second annular elements 20, 21 of the friction bearing 19 include respective facing surfaces adapted to mutually cooperate in the functions of the bearing means. These facing surfaces comprises respective first and second cylindrical surface portions in contact, arranged to withstand radial forces, and respective first and second annulus surface portions in contact, arranged to withstand axial forces.

Figure 9:
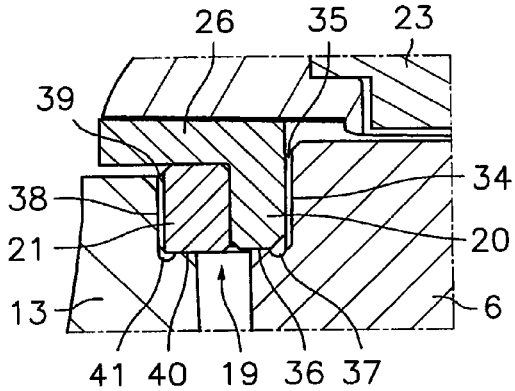
FIG. 9 is an enlarged detailed cross-sectional view taken through a plane parallel to the axis, showing a seat arrangement for a friction bearing.

As best shown in the enlarged detail of FIG. 9, corresponding to the embodiment of FIG. 3, the first annular element 20 has the first cylindrical portion formed in a cylindrical bushing and the first annulus portion formed in a perimetric flange 26 projecting from said cylindrical bushing. The second annular element 21 has the second cylindrical portion and the second annulus portion formed in side and front surfaces, respectively, of a cylindrical bushing.

Here also the core 6 and the surrounding wall 13 define seats for the first annular element 20 and the second annular element 21, respectively. In the embodiment of FIGS. 3 and 9, the first annular element 20 is made of steel, preferably stainless steel, and the second annular element 21 is made of bronze. The seat formed in the core 6 for the steel first annular element 20 of the friction bearing 19 is similar to the seats described above for the roll bearing 15, and comprises a conical surface 34 coaxial with the axis 7, provided with a degree of conicity, ribs 35 projecting from said conical surface 34 defining radial support surfaces, each of which has at least one edge coinciding with an imaginary cone coaxial with the axis 7 provided with a degree of conicity. Preferably, the entire radial support surface of each rib 35 coincides with said imaginary cone. These radial support surfaces of the ribs 35 are adapted to receive by pressurized insertion in the axial direction a cylindrical radial rest surface of the friction bearing 19. The seat further comprises an axial support surface 36 perpendicular to the axis 7 adapted to receive an axial rest surface of the friction bearing 19. In said axial support surface 36 there is formed a circumferential channel 37 adjacent to said ribs 35, the function of which is similar to that described above in relation to FIG. 7 to receive and retain material or coating of the seats pulled off by the first annular element 20 of the friction bearing 19 during an operation for installing by pressurized insertion in the axial direction.

The mentioned perimetric flange 26 of the first annular element 20 has a decreasing thickness to compensate an inclination of the inner faces of the branches 4*a*, 4*b* of the fork necessary for demolding the forearm elbow part 4 while it is obtained by injection molding. Likewise, the perimetric flange 26 and the corresponding branch 4*a* of the fork have respective mutually fitting configurations to prevent a relative rotation.

Figure 10:
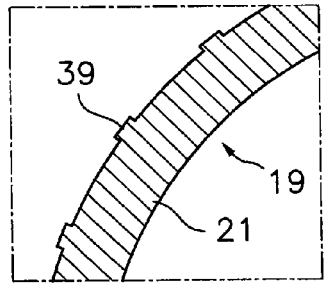
FIG. 10 is an enlarged detailed cross-sectional view taken through a plane perpendicular to the axis, showing an annular element of the friction bearing of FIG. 9.

A reverse construction has been provided for the installation of the bronze second annular element 21 of the friction bearing 19 in the surrounding wall 13. Here, the seat comprises a conical radial support surface 38, coaxial with the axis 7, provided with a degree of conicity and adapted to receive by pressurized insertion radial rest surfaces formed in ribs 39 projecting from a surface of the friction bearing 19, as best shown in the detail of FIG. 10. The mentioned radial rest surfaces of the ribs 39 of the second annular element 21 comprise at least one edge coinciding with an imaginary cylinder coaxial with the axis 7 of the articulation. Preferably, the entire radial rest surface of each rib 39 coincides with said imaginary cylinder. The seat further comprises an axial support surface 40 perpendicular to the axis 7 and adapted to receive an axial rest surface of the second annular element 21 of the friction bearing 19. A circumferential channel 41 is formed in said axial support surface 40 adjacent to said radial support surface 38 to receive and retain material or coating of the conical surface 38 of the seat pulled of by the second annular element 21 of the friction bearing 19, or house deformed material of the ribs 39 of the second annular element 21 of the friction bearing 19 during an operation for installing by pressurized insertion in the axial direction.

Given that the structural parts of the articulation device are obtained by the injection molding of a lightweight metal alloy, for example, an aluminium alloy, the degree of conicity of the conical surface 34 and of the radial support surfaces of the ribs 35 in the seat for the first annular element 20, as well as the degree of conicity of the radial support surface 38 in the seat for the second annular element 21, are adapted to facilitate the demolding during the process for obtaining the core 6 and the arm elbow part 5 defining the surrounding wall 13 by injection molding. The materials of the first and second annular elements 20, 21 of the friction bearing 19 could obviously be reversed or be others than steel and bronze, in which cases the constructions of the first and second annular elements 20, 21 and of their seats could be reversed in relation to those described with reference to FIGS. 9 and 10.

Figure 11:
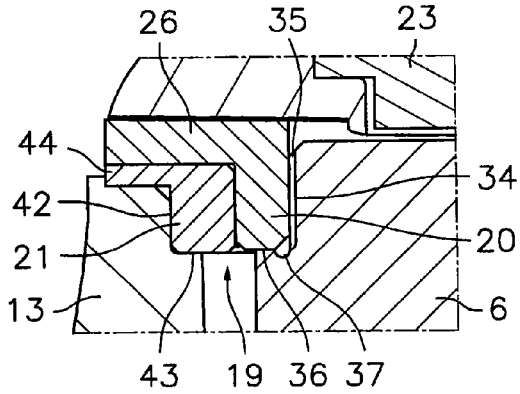
FIG. 11 is an enlarged detailed cross-sectional view taken through a plane parallel to the axis, showing another alternative arrangement for the installation of a friction bearing.

FIG. 11 shows an alternative embodiment for the bearing unit formed by the friction bearing 19, where the first annular element 20 is made of steel and the second annular element 21 is a relatively flexible or elastic material, based on a plastic polymer. Here, the constructions of the first annular element 20 and of its seat in the core 6 are identical to those described above in relation to FIG. 9. In contrast, the seat for the second annular element 21 formed in the surrounding wall 13 defines a cylindrical radial support surface 42, coaxial with the axis 7, adapted to receive by pressurized insertion a radial rest surface of the friction bearing 19, and an axial support surface 43 perpendicular to the axis 7 and adapted to receive an axial rest surface of the friction bearing 19. The annulus surface of the second annular element 21 is preferably defined in a perimetric flange 44 projecting from the corresponding cylindrical bushing, and the seat also provides a support surface for said perimetric flange 44. At least the mentioned cylindrical radial support surface 42 is obtained by modification of a conical wall by means of a machining operation carried out after obtaining the arm elbow part 5 by injection molding and eventually after applying a layer of paint or lacquer.

Figure 4:
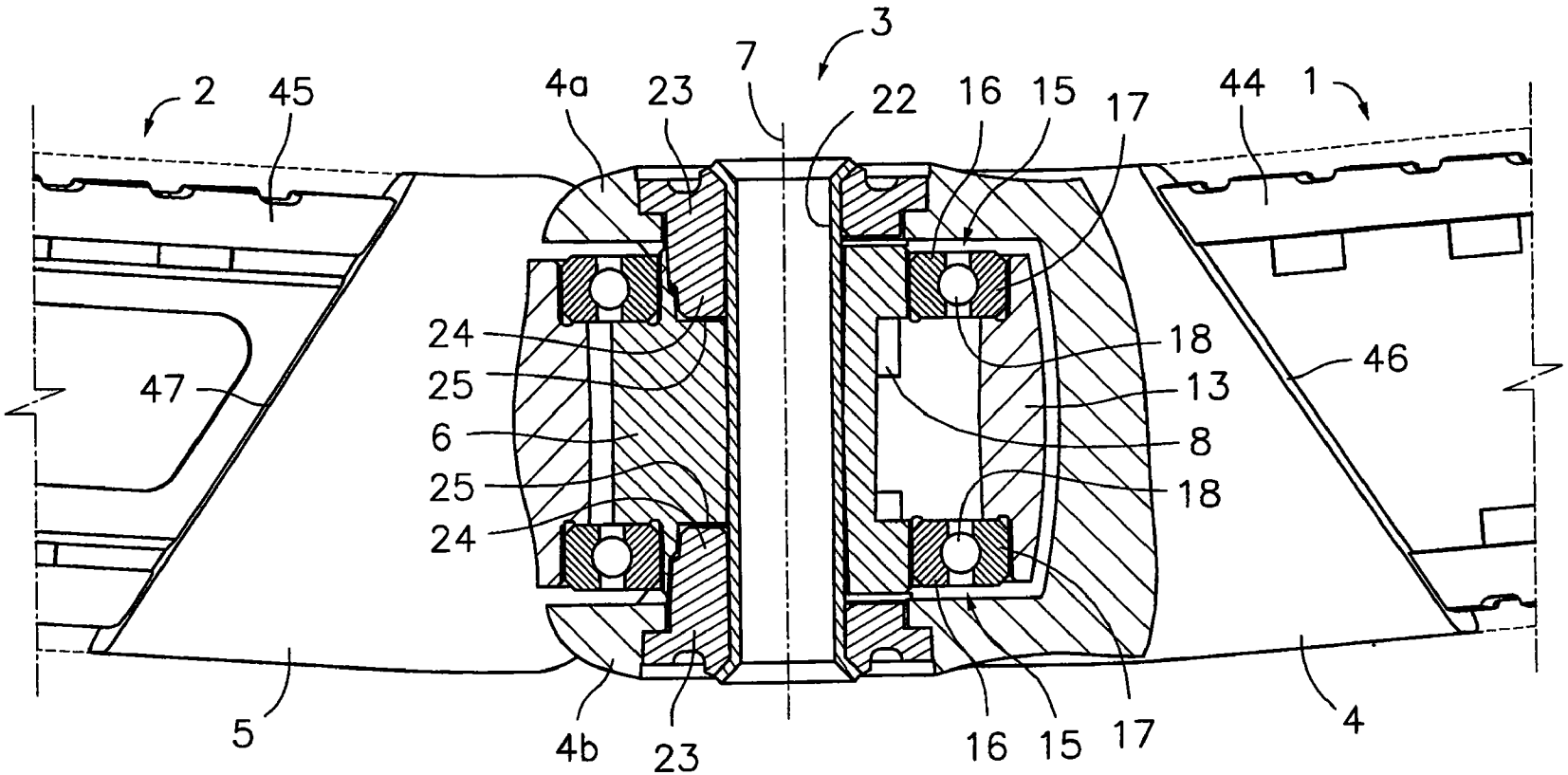
FIG. 4 is a partial cross-sectional view similar to FIG. 3, showing another embodiment of the present invention including two roll bearings.

FIG. 4 shows another embodiment in which said bearing means include two of said bearing units, which are both roll bearings 15. In this embodiment, the first annular elements 16 of both roll bearings 15 are assembled on the core 6, which is in turn fixed to the forearm elbow part 4, and the second annular elements 17 of both roll bearings 15 are assembled on the surrounding wall 13 forming part of the arm elbow part 5. To that end, in the core 6 and in the surrounding wall 13 there are formed corresponding seats similar to those described above in relation to FIGS. 7 and 8.

Figure 5:
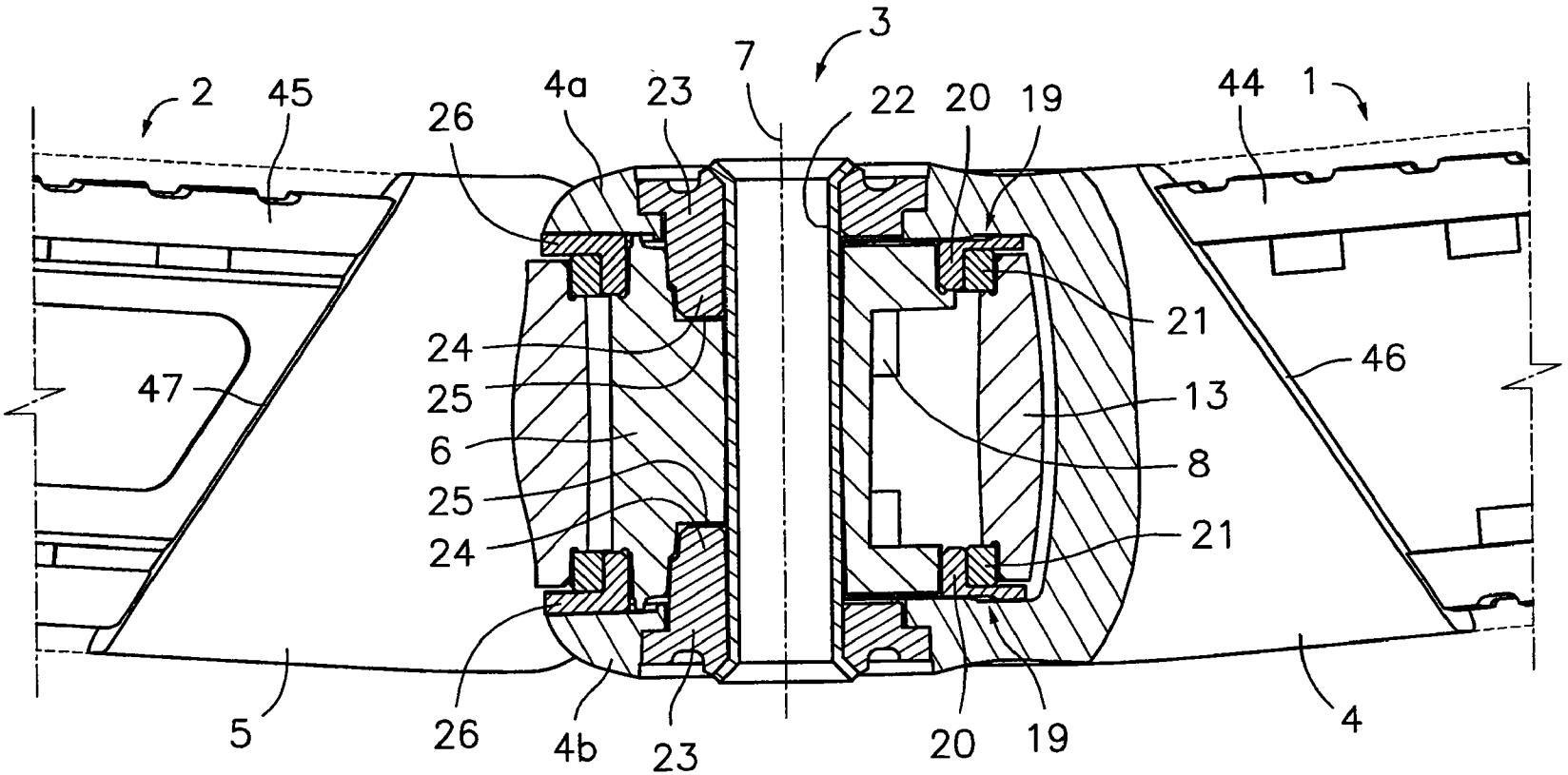
FIG. 5 is a partial cross-sectional view similar to FIG. 3, showing another embodiment of the present invention including two friction bearings.

FIG. 5 shows yet another embodiment in which said bearing means include two bearing units formed by a pair of friction bearings 19, where the first annular elements 20 of both friction bearings 19 are assembled on the core 6, which is in turn fixed to the forearm elbow part 4, and the second annular elements 21 of both friction bearings 19 are assembled on the surrounding wall 13 forming part of the arm elbow part 5. In the core 6 and in the surrounding wall 13 there are formed corresponding seats similar to those described above in relation to FIG. 9, and the second annular elements 21 of the friction bearings 19 are constructed as has been described above in relation to FIGS. 9 and 10.

In the embodiments of FIGS. 3, 4 and 5, the core 6 comprises a hole into which a central shank 22 coaxial with the axis 7 is inserted. The mentioned hole of the core has a double conicity to facilitate its demolding, whereas the central shank 22 is cylindrical. The branches 4*a*, 4*b* of the fork defined by the forearm elbow part 4 have formed therein respective openings into which corresponding centering parts 23 are inserted, provided with respective holes in which end portions of said central shank 22 are housed. The mentioned centering parts 23 and the corresponding openings formed in the branches 4*a*, 4*b* of the fork have complementary configurations (not shown) adapted to prevent a relative rotation between each centering part 23 and the corresponding branch 4*a*, 4*b* of the fork in which it is installed. Furthermore, each of said centering parts 23 comprises a projecting configuration 24 adapted to be fitted into a corresponding cavity 25 formed in the core 6, which prevents a relative rotation between the core 6 the centering parts 23. Thus, a rotation of the core 6 in relation to the forearm elbow part 4 is prevented. The central shank 22 is tubular and has its ends flared against the mouths of the holes of the centering parts 23. The ends of the central shank 22 are flared in a final assembly operation, whereby the core 6 and the centering parts 23 are packed together with the fork 4*a*, 4*b* defined by the forearm elbow part 4, and the core 6 is integrally fixed to the forearm elbow part 4. Plastic decorative covers (not shown) can be coupled on the flared ends of the central shank 22.

Figure 6:
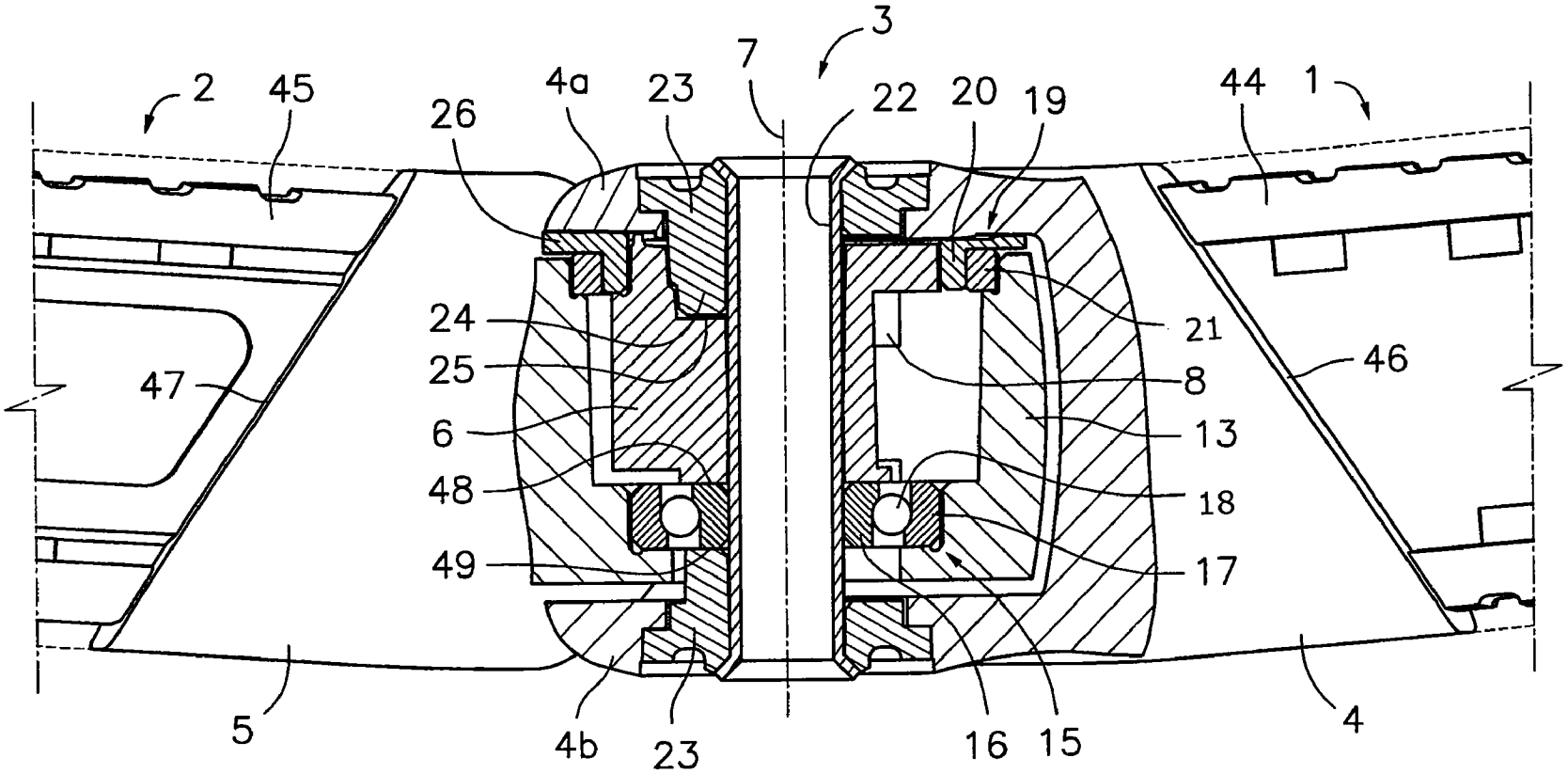
FIG. 6 is a partial cross-sectional view similar to FIG. 3, showing another embodiment of the present invention including a roll bearing and a friction bearing in an alternative arrangement.

FIG. 6 shows an alternative arrangement for the embodiment described above in relation to FIG. 3, where the bearing means include a roll bearing 15 and a friction bearing 19. The construction of the friction bearing 19 and of the corresponding seats for the first and second annular elements 20, 21 in the core 6 and the surrounding wall 13 are similar to those described above in relation to FIGS. 3, 7 and 8. However, in this embodiment, the first annular element 16 of the roll bearing 15 is assembled on the central shank 22, more specifically, the core 6 leaves a portion of the central shank 22 bare, and the roll bearing 15 is assembled on said bare portion. Thus, the mentioned bare portion of the central shank 22 acts as the radial support surface for the radial rest surface of the first annular element 16 of the roll bearing 15. The seat formed in the surrounding wall 13 for the second annular element 17 of the roll bearing 15 is similar to that described above in relation to FIGS. 3, 7 and 8. In this embodiment, the construction of the friction bearing 19 as well as of the seats formed in the core 6 and in the surrounding wall 13 for the first and second annular elements 20, 21 of the friction bearing 19 is similar to that described above in relation to FIGS. 3, 9 and 10.

A person skilled in the art will be able to make modifications, variations and different combinations from the embodiments shown and described without departing from the scope of the present invention as it is defined in the attached claims.

The invention claimed is:

1. An articulation device for an awning arm elbow, said awning arm being formed by a forearm and an arm articulated in said elbow, of the type comprising:

a forearm elbow part defining a fork between the branches of which a core configured around an axis is fixedly supported, with an anchoring configuration formed in said core to couple an enlarged end of a flexible tie rod element connected to at least one elastic member secured inside said arm;

an arm elbow part defining a surrounding wall arranged around said core with a clearance between both to accommodate said flexible tie rod element; and bearing means arranged to guide a relative rotation between said forearm elbow part and said arm elbow part around said axis and to support the forearm in the arm;

wherein said bearing means including at least one bearing unit comprising a first annular element which is fixed to the forearm elbow part and a second annular element which is fixed to the arm elbow part, said first and second annular elements including respective facing surfaces adapted to mutually cooperate in the functions of the bearing means, wherein the core fixed to the forearm elbow part and the surrounding wall defined by the arm elbow part comprise respective seats for said first annular element and said second annular element, wherein at least one of said seats comprises:

a conical surface coaxial with the axis;

ribs projecting from said conical surface defining radial support surfaces coinciding with a cone coaxial with the axis and adapted to receive by pressurized insertion a radial rest surface of the corresponding first or second annular element;

an axial support surface perpendicular to the axis and adapted to receive an axial rest surface of the corresponding first or second annular element; and a circumferential channel formed in said axial support surface adjacent to said ribs.

2. The device according to claim 1, wherein the conical surface and said cone coinciding with said radial support surfaces of the ribs have a degree of conicity adapted to allow demolding when the core and/or the arm elbow part defining the surrounding wall are obtained by molding.

3. The device according to claim 2, wherein the core and the arm elbow part defining the surrounding wall including the corresponding seats are completely coated with a layer of paint or lacquer.

4. The device according to claim 1, wherein said bearing unit is selected from a group comprising a roll bearing or a friction bearing.

5. The device according to claim 1, wherein said bearing means include at least two bearing units selected from a group comprising two roll bearings one roll bearing and one friction bearing, or two friction bearings.

6. The device according to claim 5, wherein a central shank coaxial with the axis is inserted in a through hole of the core and fixed at its ends to the branches of the fork defined by the forearm elbow part wherein a bare portion of said central shank provides a radial support surface for a radial rest surface of the first annular element of one of said at least two bearing units, and the core provides an axial support surface for an axial rest surface of the first annular element.

7. The device according to claim 5, wherein the roll bearing or at least one of the roll bearings is adapted to withstand radial forces and axial forces.

8. The device according to claim 4, wherein said first and second annular elements of said friction bearing includes respective first and second cylindrical surface portions coaxial with the axis in contact to withstand radial forces and respective first and second annulus surface portions perpendicular to the axis in contact to withstand axial forces.

9. The device according to claim 5, wherein said first and second annular elements of said friction bearing or of at least one of said friction bearings includes respective first and second cylindrical surface portions coaxial with the axis in contact to withstand radial forces and respective first and second annulus surface portions perpendicular to the axis in contact to withstand axial forces.

10. The device according to claim 8, wherein the first annular element of the friction bearing comprises a cylindrical bushing providing said first cylindrical surface portion and a perimetric flange projecting from said cylindrical bushing providing said first annulus surface portion, and the second annular element comprises a cylindrical bushing having side and front surfaces providing said second cylindrical surface portion and said second annulus surface portion, respectively.

11. The device according to claim 9, wherein the first annular element of the friction bearing comprises a cylindrical bushing providing said first cylindrical surface portion and a perimetric flange projecting from said cylindrical bushing providing said first annulus surface portion, and the second annular element comprises a cylindrical bushing having side and front surfaces providing said second cylindrical surface portion and said second annulus surface portion, respectively.

12. The device according to claim 1, wherein at least one of said seats defined in the core or in the surrounding wall comprises:

a conical radial support surface coaxial with the axis and adapted to receive by pressurized insertion radial rest surfaces provided in ribs projecting from an outer surface of the corresponding first or second annular element;

an axial support surface perpendicular to the axis and adapted to receive an axial rest surface of the corresponding first or second annular element; and a circumferential channel formed in said axial support surface adjacent to said radial support surface.

13. The device according to claim 12, wherein said conical radial support surface has a degree of conicity adapted to allow when the core and/or the arm elbow part defining the surrounding wall are obtained by molding.

14. The device according to claim 13, wherein the core and/or the arm elbow part defining the surrounding wall are completely coated with a layer of paint or lacquer.

15. The device according to claim 1, wherein the core comprises a hole into which a central shank coaxial with the axis is inserted and the mentioned branches of the fork defined by the forearm elbow part have formed therein respective openings into which respective centering parts are inserted, said centering parts comprising respective holes in which end portions of said central shank are housed.

16. The device according to claim 12, wherein the central shank is tubular and its ends are flared against the mouths of the holes of the centering parts.

17. The device according to claim 12, wherein the centering parts and the corresponding openings formed in the branches of the fork have complementary configurations adapted to prevent a relative rotation, and at least one of said centering parts comprises a projecting configuration adapted to be fitted into a corresponding cavity formed in the core to prevent a relative rotation.

* * * * *